US008052136B2

(12) United States Patent
Sato et al.

(10) Patent No.: US 8,052,136 B2
(45) Date of Patent: Nov. 8, 2011

(54) SHEET CONVEYANCE RELAY UNIT AND IMAGE FORMING SYSTEM USING THE SAME UNIT

(75) Inventors: Hiroyasu Sato, Machida (JP); Toshio Shida, Higashiyamato (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 244 days.

(21) Appl. No.: 12/482,839

(22) Filed: Jun. 11, 2009

(65) Prior Publication Data

US 2009/0309301 A1 Dec. 17, 2009

(30) Foreign Application Priority Data

Jun. 17, 2008 (JP) ..... 2008-157627

(51) Int. Cl.
*B65H 3/44* (2006.01)
*B65H 5/00* (2006.01)
*B65H 29/00* (2006.01)

(52) U.S. Cl. ..... 271/9.13; 271/225; 271/298; 271/303; 271/184; 271/185; 271/186

(58) Field of Classification Search ..... 271/3.14, 271/3.19, 9.13, 225, 298, 303, 184, 185, 271/186; 270/58.23, 58.14
See application file for complete search history.

(56) References Cited

U.S. PATENT DOCUMENTS

| | | | | |
|---|---|---|---|---|
| 6,227,540 | B1 | 5/2001 | Nakamura et al. | |
| 7,076,200 | B2 | 7/2006 | Poletto | |
| 7,568,685 | B2 * | 8/2009 | Silberbauer | 270/58.07 |
| 2007/0001361 | A1 | 1/2007 | Nakamura et al. | |
| 2008/0042342 | A1 * | 2/2008 | Tominaga et al. | 271/298 |
| 2008/0112743 | A1 | 5/2008 | Moore | |
| 2008/0211164 | A1 * | 9/2008 | Sugizaki | 271/9.06 |

FOREIGN PATENT DOCUMENTS

| | | | |
|---|---|---|---|
| JP | 59-167447 | A | 9/1984 |
| JP | 61-111277 | U | 7/1986 |
| JP | 8-276683 | A | 10/1996 |
| JP | 11-322157 | A | 11/1999 |
| JP | 2002-193541 | A | 7/2002 |
| JP | 2006-124180 | A | 5/2006 |
| JP | 2006-347634 | A | 12/2006 |
| JP | 2008-120598 | A | 5/2008 |

OTHER PUBLICATIONS

Japanese Office Action dated Apr. 20, 2010 and English translation thereof, issued in counterpart Japanese Application No. 2008-157627.

* cited by examiner

*Primary Examiner* — David H Bollinger
(74) *Attorney, Agent, or Firm* — Holtz, Holtz, Goodman & Chick, P.C.

(57) ABSTRACT

A sheet conveyance relay unit, including: a convergence unit, including: a convergence section, in which a plurality of sheet receiving sections are respectively connected to a plurality of image forming apparatuses, to receive recording sheets, wherein the convergence section makes the recording sheets, conveyed from the plurality of the sheet receiving sections, to merge into a single sheet conveyance path; and a first common sheet-conveyance section, which conveys the recording sheets from the convergence section to a sheet feeding outlet, and a divergence unit, including: a second common sheet-conveyance section, which conveys the recording sheets, conveyed from the convergence unit; a plurality of sheet feed-out sections, which are combined to a plurality of post-finishing apparatuses; and a divergence section, which sorts the recording sheets, conveyed by the second common sheet-conveyance section, onto the plurality of the sheet feed-out sections.

20 Claims, 7 Drawing Sheets

SHEET CONVEYANCE RELAY UNIT AND IMAGE FORMING SYSTEM USING THE SAME UNIT

CROSS REFERENCE TO RELATED APPLICATION

This application is based on Japanese Patent Application No. 2008-157627 filed on Jun. 17, 2008, with the Japanese Patent Office, the entire content of which is hereby incorporated by reference.

TECHNICAL FIELD

The present invention relates to a sheet conveyance relay unit, which conveys a recording sheet, sent from an image forming apparatus, to a post-finishing apparatus, and relates to an image forming system, which is structured of the image forming apparatus, the post-finishing apparatus, and the sheet conveyance relay unit.

BACKGROUND OF THE INVENTION

In recent years, image forming systems have been widely used, in which a post-finishing apparatus is combined to an image forming apparatus, whereby various post-finishing processes, such as a de-curling process, a sheet reversing process, a hole punching process, a sheet folding process, and a sheet binding process, are conducted on sheets carrying images printed by the image forming apparatus.

Generally in such systems, a single post-finishing apparatus is combined to a single image forming apparatus, however, there are many image forming systems in which a single post-finishing apparatus is combined to a plurality of image forming apparatuses, or a plurality of post-finishing apparatuses are combined to a single image forming apparatus.

Unexamined Japanese Patent Application Publication No. 8-276,683 discloses an image forming system in which a single post-finishing apparatus is combined to a plurality of image forming apparatuses, while Unexamined Japanese Patent Application Publication No. 2006-347,634 discloses an image forming system in which a plurality of post-finishing apparatuses are combined to a single image forming apparatus.

Further, Unexamined Japanese Patent Application Publication No. 2006-124,180 discloses an image forming system in which a plurality of post-finishing apparatus are combined to a plurality of image forming apparatuses.

Due to advancement toward full color image formation from monochromatic image formation, speeding up of image formation, changing toward multifunction, and separation of functions, each generated in the field of the image forming apparatuses, as well as, due to speeding up of post-finishing, diversification of the function and separation of the function, each generated in the field of the post-finishing apparatuses, many parties have tried to meet users' diversifying needs, by increasing the number of the combinations between the image forming apparatuses and the post-finishing apparatuses, or by flexibly changing these combinations.

However, in actual working fields, conventional systems barely meet the increased types of operational jobs, nor improvement of printing productivity, which are problematic matters.

SUMMARY OF THE INVENTION

The above problems can be solved by items described below.

Item 1. A sheet conveyance relay unit, including:

a convergence unit, incorporating:

a convergence section, in which a plurality of sheet receiving sections, which receive recording sheets, having been conveyed from an image forming apparatus, are respectively connected to a plurality of image forming apparatuses, and said convergence section makes the recording sheets, having been conveyed from the plurality of the sheet receiving sections, to merge into a single sheet conveyance path; and a first common sheet-conveyance section, which conveys the recording sheets from the convergence section to a sheet feeding outlet; and a divergence unit, incorporating:

a second common sheet-conveyance section, which conveys the recording sheets, having been conveyed from the convergence unit;

a plurality of sheet feed-out sections, which are combined to a plurality of post-finishing apparatuses; and a divergence section, which sorts the recording sheets, having been conveyed by the second common sheet-conveyance section, onto the plurality of sheet feed-out sections.

Item 2. An image forming system, including:

a plurality of image forming apparatuses, each of which forms images on recording sheets and sends out the recording sheets;

a plurality of post-finishing apparatuses, each of which conducts a post-finishing process on the recording sheet; and the sheet conveyance relay unit, described in Item 1, which receives the recording sheets, having been sent from one of the plurality of image forming apparatuses, with respect to the respective image forming apparatuses, and conveys the recording sheets to the plurality of post-finishing apparatuses.

BRIEF DESCRIPTION OF THE DRAWINGS

The embodiments will now be described, by way of example only, with reference to the accompanying drawings which are meant to be exemplary, not limiting, and wherein like elements are numbered alike in the several figures, in which.

DETAILED DESCRIPTIONS OF THE PREFERRED EMBODIMENTS

Figure 1:
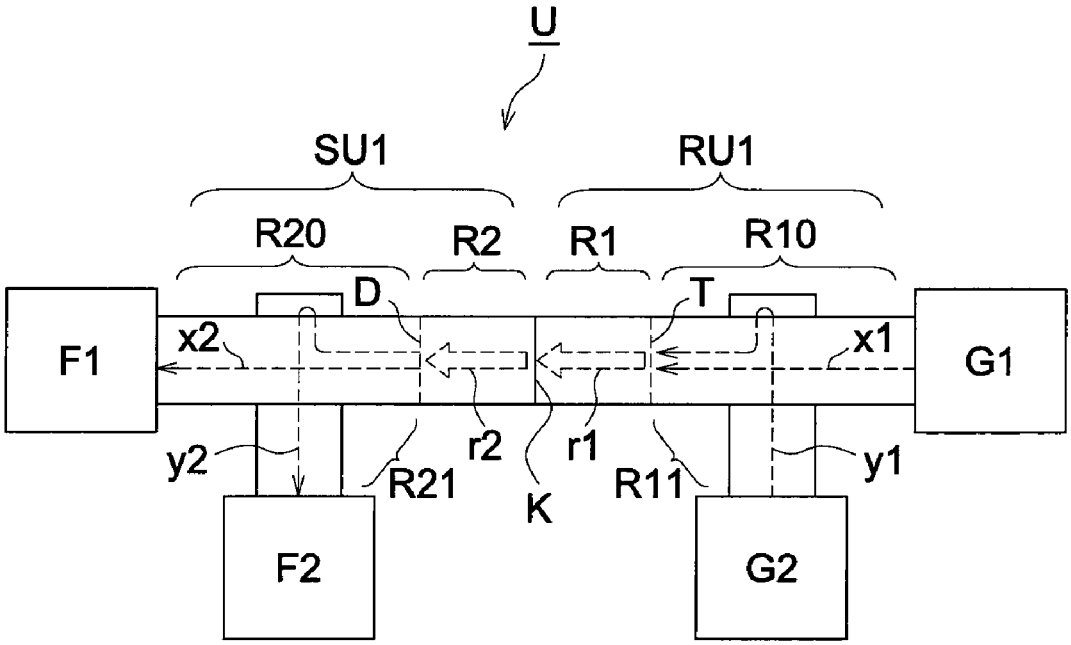
FIG. 1 is a block diagram of an image forming system of the present invention.

Embodiments of the present invention will now be detailed, while referring to the drawings. The present invention is not limited to the embodiments.

FIG. 1 is a block diagram of the image forming system of the present invention.

The image forming system shown in FIG. 1 shows image forming apparatuses G1 and G2, which are connected via sheet conveyance relay unit U, to sheet post-finishing apparatuses F1 and F2.

Sheet conveyance relay unit U is structured of two units, which are convergence unit RU1 and divergence unit SU1, and which are connected through connecting section K.

After a recording sheet is conveyed from image forming apparatus G1, the recording sheet is conveyed through conveyance path x1 of sheet receiving section R10 of convergence unit RU1, the recording sheet is subsequently conveyed to first common sheet-conveyance section R1, through convergence section T.

After another recording sheet is conveyed from image forming apparatus G2, the recording sheet is conveyed through conveyance path y1 of sheet receiving section R11, provided under said conveyance path x1, the recording sheet is subsequently reversed two times, and its conveyance direction is turned 90 degrees, so that the recording sheet is conveyed to first common sheet-conveyance section R1, through convergence section T.

The recording sheet, having been conveyed through conveyance path r1 of common sheet-conveyance section R11 passes through connecting section K, which is a sheet feeding outlet of convergence unit RU1, and the recording sheet is subsequently conveyed to divergence section D through conveyance path r2 of second common sheet-conveyance section R2 of divergence unit SU1.

The recording sheet, having arrived at divergence section D, is sorted to direct to conveyance path x2 of sheet feed-out section R20, or conveyance path y2 of sheet feed-out section R21.

Sheet feed-out sections R20 and R21 convey the recording sheet, having been directed by divergence section D, at predetermined timing and conveyance speed, to post-finishing sections F1 and F2, respectively.

Figure 2:
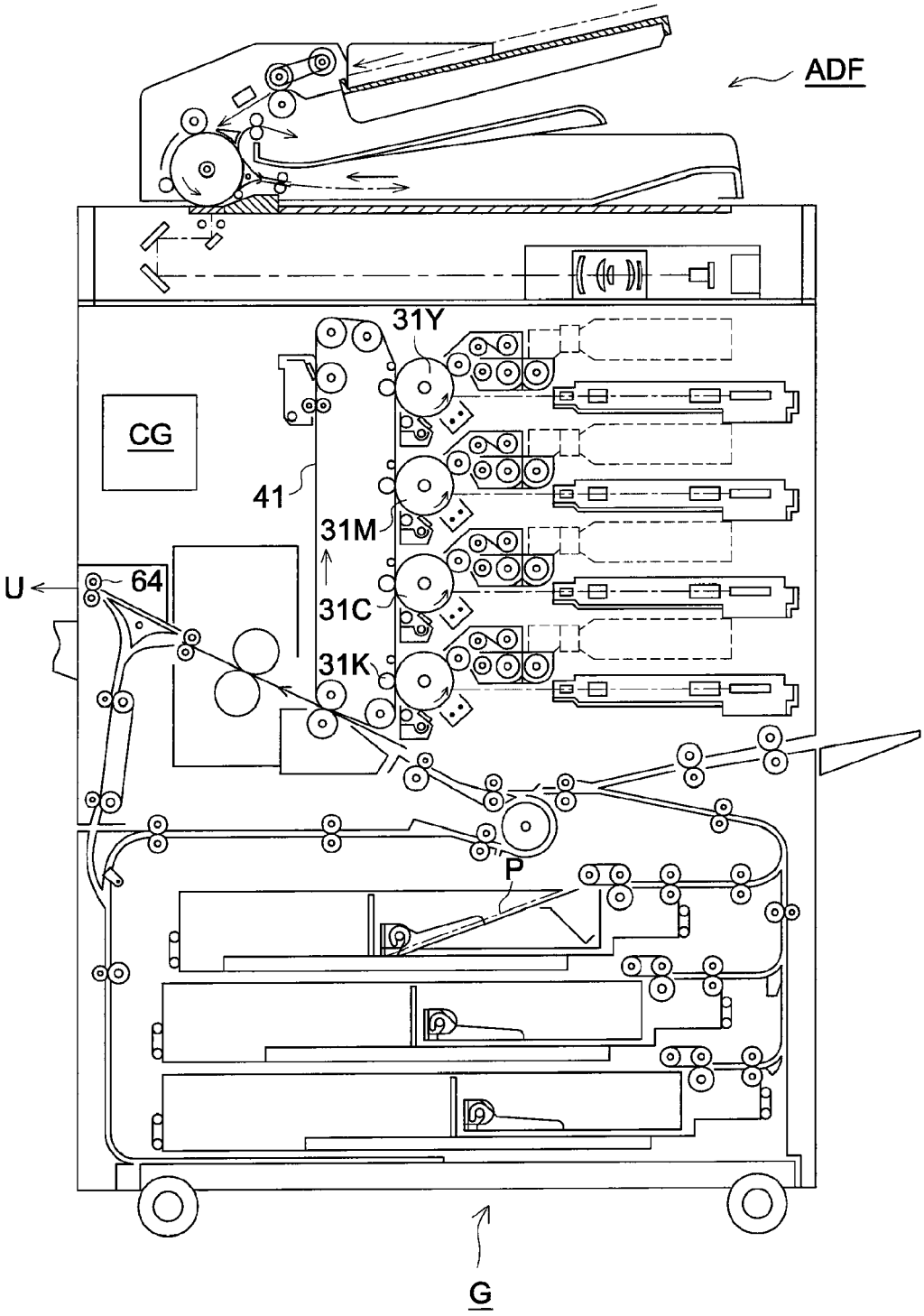
FIG. 2 is a schematic drawing of a full color image forming apparatus.

FIG. 2 is a schematic drawing of full color image forming apparatus G.

Full color image forming apparatus G is a well-known tandem type image forming apparatus, as disclosed in Unexamined Japanese Patent Application Publication No. 2007-241,175, which includes photoconductors 31Y, 31M, 31C and 31K, aligned vertically to face a single intermediate transfer belt 41, to generate full color images.

Image forming processes are conducted on a recording sheet, based on information which has been acquired by automatic document feeding device ADF, provided on full color image forming apparatus G, or based on information which has been sent from other information devices. After that, the recording sheet carrying the processed images is conveyed by paired feed-out rollers 64 to sheet conveyance relay unit U, which is installed downstream of full color image forming apparatus G.

Said sheet conveyance relay unit U can be combined to a monochromatic high-speed image forming apparatus, as well as to full color image forming apparatus G. Said sheet conveyance relay unit U can be combined to the image forming apparatuses in different types, or to a plurality of image forming apparatuses in the same type.

Figure 3:
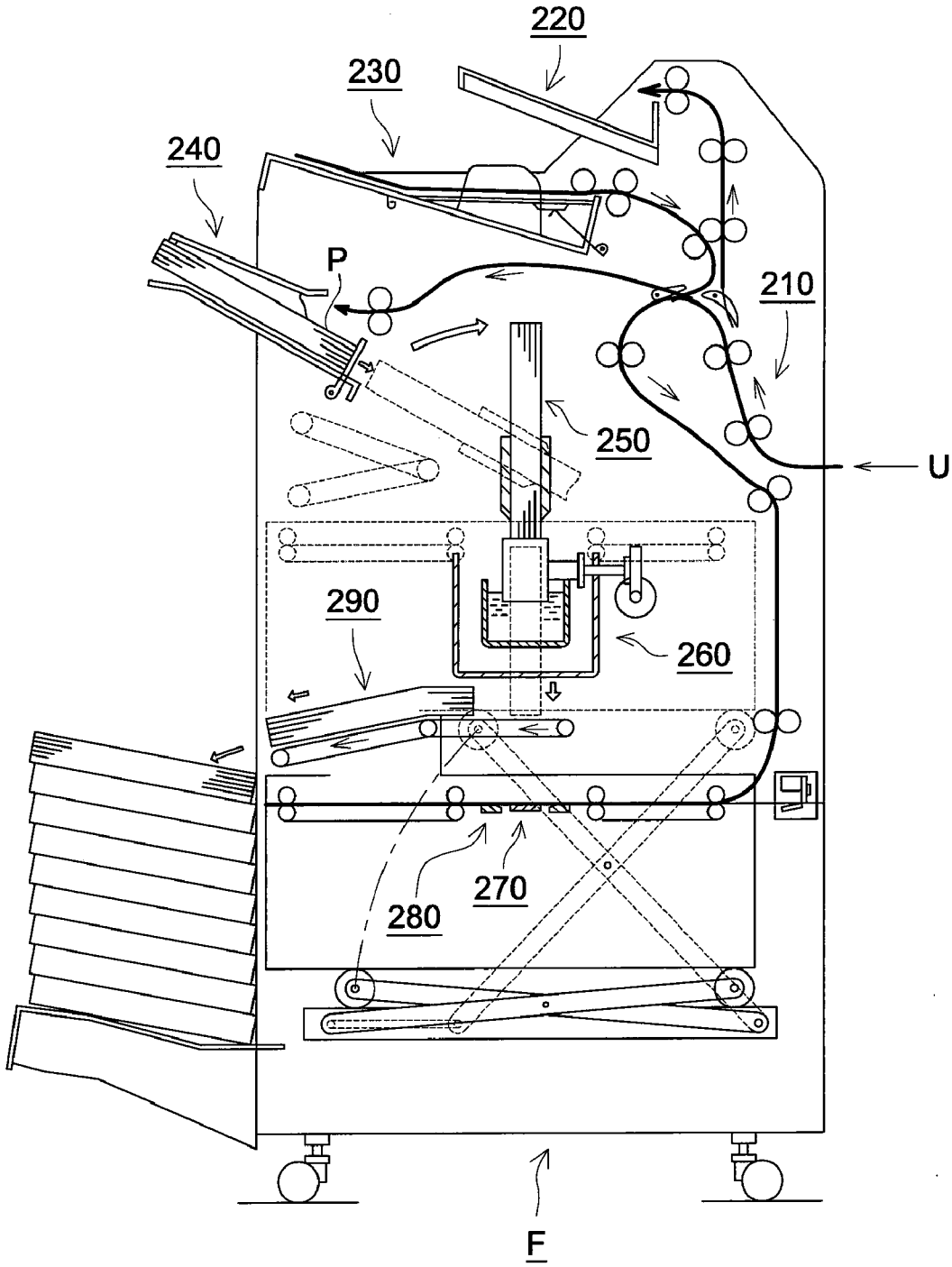
FIG. 3 is a schematic drawing of a post-finishing apparatus.

FIG. 3 is a schematic drawing of post-finishing apparatus F.

Post-finishing apparatus F is configured to stack the recording sheets, conveyed from sheet conveyance relay unit U, to become a bundle of sheets, and to adhere cover sheets onto said bundle of sheets.

Post-finishing apparatus F of the present embodiment is referred to as a book-binding apparatus, which includes sheet conveyance section 210, sheet ejection section 220, cover sheet supplying section 230, sheet-bundle accommodating section 240, sheet-bundle supporting section 250, adhesive applying section 260, cover sheet adhering section 270, cover sheet folding section 280, and finished booklet ejecting section 290.

As shown in FIG. 3, the above sections are vertically arranged in post-finishing apparatus F.

When a book-binding job is conducted, the recording sheets are stacked sequentially on a predetermined position of sheet-bundle accommodating section 240, whereby a sheet-bundle, including a predetermined number of the recording sheets, is formed.

The sheet-bundle, formed on sheet-bundle accommodating section 240, is conveyed to sheet-bundle supporting section 250, whereby when said sheet-bundle supporting section 250 is rotated to be nearly vertical, the adhesive is applied onto the bottom of said sheet-bundle by adhesive applying section 260.

After a cover sheet is supplied from cover sheet adhering section 270 onto the adhesive carrying bottom of the sheet-bundle, the cover sheet is folded by cover sheet folding section 280, whereby a booklet is finished.

Said finished booklet is then ejected from post-finishing apparatus F by finished booklet ejecting section 290.

Additionally, above post-finishing apparatus F is detailed in Unexamined Japanese Patent Application Publication No. 2004-209,869.

Figure 4:
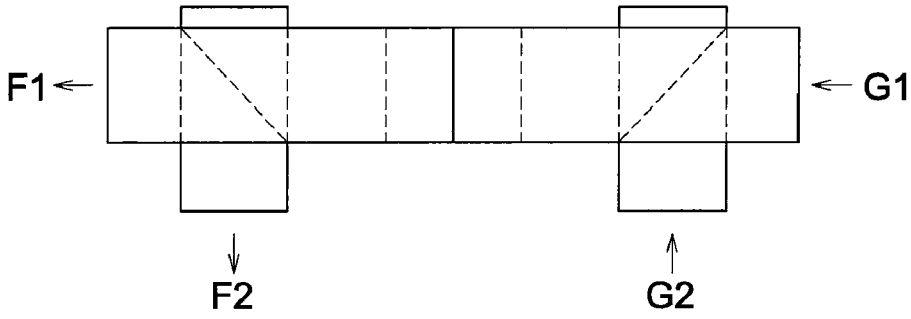
FIG. 4(*a*), FIG. 4(*b*), and FIG. 4(*c*) are schematic drawings of a sheet conveyance relay unit as an embodiment.
Figure 4:
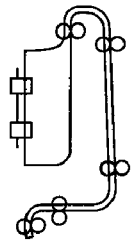
Figure 4:
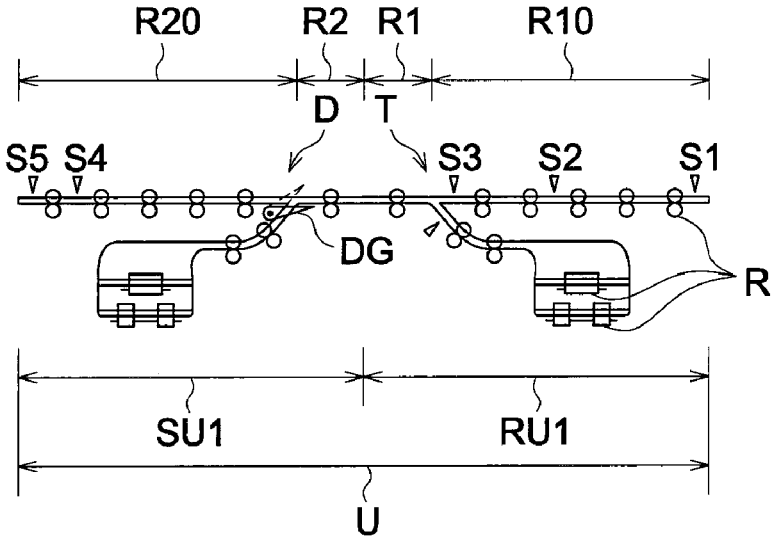

FIGS. 4(*a*), 4(*b*) and 4(*c*) are schematic drawings of sheet conveyance relay unit U, in which FIG. 4(*a*) is a top view, FIG. 4(*b*) is a front view, and FIG. 4(*c*) is a side view.

Sheet conveyance relay unit U is structured of a plurality of guide members (which are not illustrated) to control the conveyance direction of the recording sheet, divergence guide DG to change the conveyance direction of the recording sheet, conveyance roller group R including a plurality of paired rollers, roller driving member RD (which is not illustrated), and a plurality of sheet detecting sensors S to detect the recording sheet.

Figure 5:
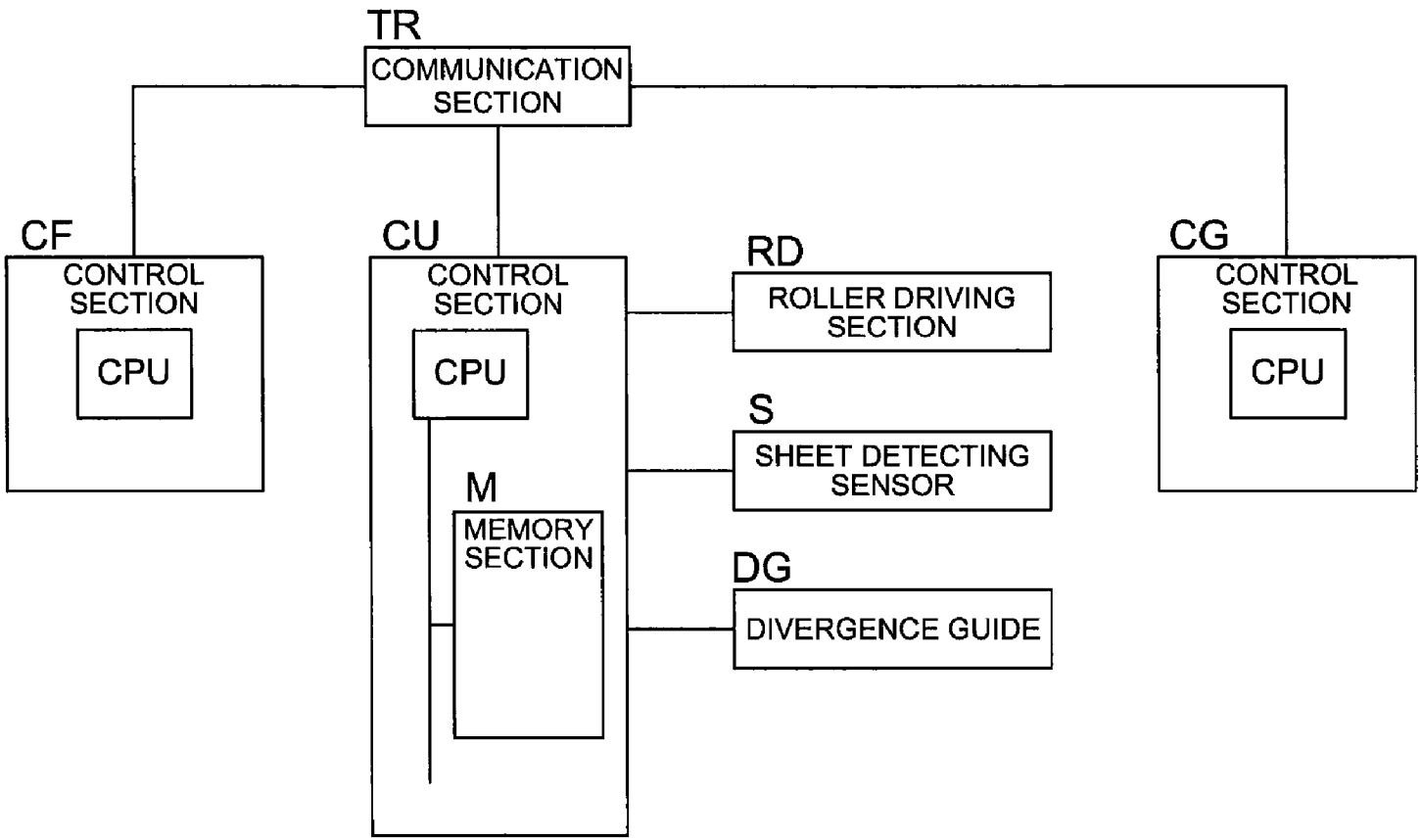
FIG. 5 is a block diagram of a control system of a sheet conveyance relay unit.

FIG. 5 is a block diagram of the control system of sheet conveyance relay unit U.

Control section CU is a computer system, including a CPU, memory section M, an input-output interface, a communication interface, and a plurality of driving circuits.

Control section CU conducts various control operations, by running predetermined programs which are stored in memory section M.

Control section CU, control section CG of full color image forming apparatus G, and control section CF of post-finishing apparatus F exchange information with each other through communication section TR.

In addition, any operational blocks, which have no relationship to the present invention, are not shown in FIG. 5.

A structure of sheet conveyance relay unit U will be detailed, while referring to FIGS. 1, 4(*a*), 4(*b*), and 5.

In FIG. 1, the recording sheet, conveyed from image forming apparatus G1 or G2 to sheet conveyance relay unit U, is conveyed to post-finishing apparatus F1 or F2.

In sheet conveyance relay unit U, the recording sheet is conveyed by a plurality of conveyance rollers R, driven by roller driving section RD, and the rotating speed of which is controlled by control section CU.

In FIG. 4(*b*), the leading edge of the recording sheet, conveyed from image forming apparatus G1, is detected by sheet detecting sensor S1. Control section CU controls the rotating speed of the plurality of conveyance rollers R of sheet receiving section R10, so that the sheet conveyance speed becomes equal to the sheet ejecting speed of image forming apparatus G1.

After the trailing edge of the recording sheet is detected by sheet detecting sensor S1, control section CU controls the rotating speed of the plurality of conveyance rollers R of sheet receiving section R10, so that the sheet conveyance speed increases to be a predetermined speed.

When the leading edge of the recording sheet is detected by sheet detecting sensor S2, the sheet conveyance speed is controlled to be lower, and when the leading edge of the recording sheet is detected by sheet detecting sensor S3, the recording sheet is stopped, whereby the recording sheet is under a waiting condition.

When no recording sheet exists in conveyance path r1 of first common sheet-conveyance section R1, that is, when a recording sheet can be accepted by conveyance path r1, the recording sheet, which still remains under the waiting condition, is then sent to convergence section T.

In addition, when the leading edge of the recording sheet is detected by sheet detecting sensor S2, if there is no recording sheet in conveyance path r1 of first common sheet-conveyance section R1, that is, a recording sheet can be accepted by conveyance path r1, the recording sheet is conveyed to divergence section T, without being under the waiting condition.

The recording sheet, having been conveyed from convergence section T to first common sheet-conveyance section R1, is conveyed to divergence section D, through second common sheet-conveyance section R2.

Divergence section D is a section where conveyance path r2 of second common sheet-conveyance section R2 branches into conveyance path x2 of sheet feed-out section R20 and into conveyance path y2 of sheet feed-out section R21.

Divergence guide DG, which switches the conveyance direction of the recording sheet, is mounted on divergence section D. That is, the recording sheet, being conveyed through conveyance path r2 of second common sheet-conveyance section R2, is directed to either conveyance path x2 of sheet feed-out section R20 or conveyance path y2 of sheet feed-out section R21.

When the leading edge of the recording sheet, having been conveyed to sheet feed-out section R20, is detected by sheet detecting sensor S4, the conveyance speed of said recording sheet is appropriately lowered to receive the recording sheet in the post-finishing apparatus.

Further, when the leading edge of said recording sheet is detected by sheet detecting sensor S5, said recording sheet is stopped, whereby the recording sheet is under the waiting condition.

Further, in a case that when the leading edge of the recording sheet is detected by sheet detecting sensor S5, and if post-finishing apparatus F1 is capable of receiving the recording sheet, the recording sheet is conveyed toward post-finishing apparatus F1, that is, the recording sheet does not remain under the waiting condition.

The above explanations make it clear that sheet receiving section R10 horizontally and directly conveys the recording sheet, sent from image forming section G1, to convergence section T, and that sheet feed-out section R20 horizontally and directly conveys the recording sheet, sent from divergence section D, to post-finishing section F1.

The recording sheet, conveyed from image forming apparatus G2, and received by sheet receiving section R11, is changed 90 degrees in its conveyance direction, and is then conveyed to convergence section T. Sheet stopping control and conveyance speed control, are conducted in the same way as in the case of sheet receiving section R10, each conducted based on signals coming from a plurality of sheet detecting sensors.

Though said sheet receiving section R10 includes conveyance path x1, through which the recording sheet is conveyed horizontally and directly, said sheet receiving section R11 includes conveyance path y1, through which the recording sheet is reversed two times, and changed 90 degrees in its conveyance direction, so that said recording sheet is conveyed to convergence section T.

Any difference between sheet feed-out section R20, through which the recording sheet is conveyed from convergence section D to post-finishing apparatus F1 or post-finishing apparatus F2, and sheet feed-out section R21, is the same as the difference between sheet receiving section R10 and sheet receiving section R11.

Figure 6:
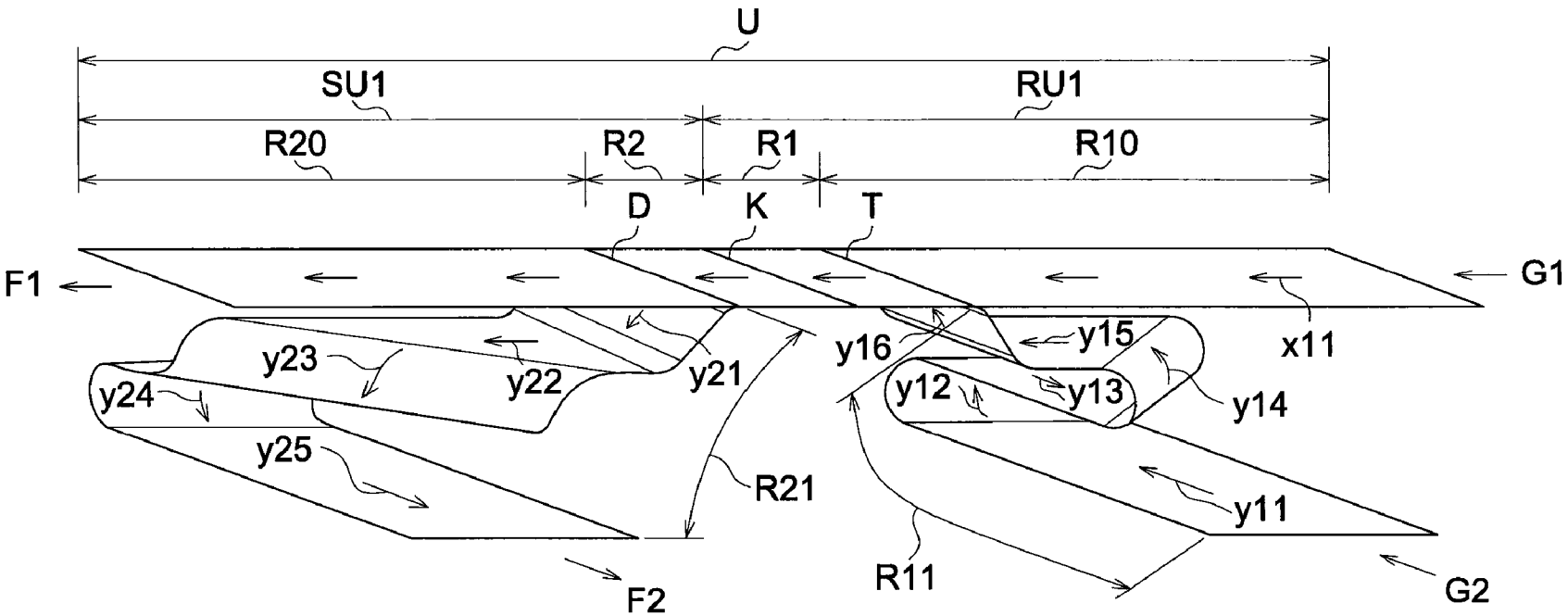
FIG. 6 shows sheet conveyance directions and changes of sheet surfaces.

FIG. 6 shows sheet conveyance directions and reversal of sheet surfaces, in sheet conveyance relay unit U.

A plurality of arrows in FIG. 6 show conveyance directions of the recording sheet, which is conveyed by sheet conveyance relay unit U.

Sheet receiving section R11 conveys the recording sheet, conveyed from image forming apparatus G2, in direction y11. Said direction y11 makes a right angle with direction x11, wherein sheet receiving section R10 conveys the recording sheet, conveyed from image forming apparatus G1, in direction x11.

The recording sheet, conveyed below sheet receiving section R10 in direction y11, is directed upward in direction y12, and then conveyed in direction y13. That is, the recording sheet is changed 180 degrees in its conveyance direction, and its surface is reversed.

After that, said recording sheet is changed 90 degrees in its conveyance direction below sheet receiving section R10 by a guide member (which is not illustrated), subsequently said recording sheet is conveyed upward in direction y14, and further conveyed in direction y15. That is, said recording sheet is changed 90 degrees in its conveyance direction, and its surface is again reversed.

As described above, the recording sheet, conveyed from image forming apparatus G2, is then conveyed in direction y16, while its conveyance direction and its surface are the same as those of the sheet, conveyed from image forming apparatus G1, whereby the recording sheet, conveyed from image forming apparatus G2, reaches convergence section T.

Sheet feed-out section R21, which conveys the recording sheet, conveyed from divergence section D to post-finishing apparatus F2, is structured nearly the same way as said sheet receiving section R10, whereby sheet feed-out section R21 conveys the recording sheet from divergence section D to post-finishing apparatus F2 in directions y21-y25.

As described above, in the sheet conveyance relay unit of the present invention, the recording sheet is always conveyed with the same leading edge.

Due to this conveyance manner, the conveyance speed need not be reduced. Because, as shown in conventional apparatuses, after the recording sheet is stopped, the edge of the recording sheet is turned 90 degrees to become the new leading edge for the subsequent conveyance, whereby the conveyance direction of said recording sheet is changed, which reduces the overall conveyance speed.

In the above descriptions, the image forming system is detailed as the embodiment of the present invention, in which two image forming apparatuses are combined with two post-finishing apparatuses by the sheet conveyance relay unit. However, since the sheet conveyance relay unit of the present invention can combine convergence units with each other, or can combine divergence units with each other, the number of the image forming apparatuses and the number of the post-finishing apparatuses to be combined are not specifically limited.

Figure 7:
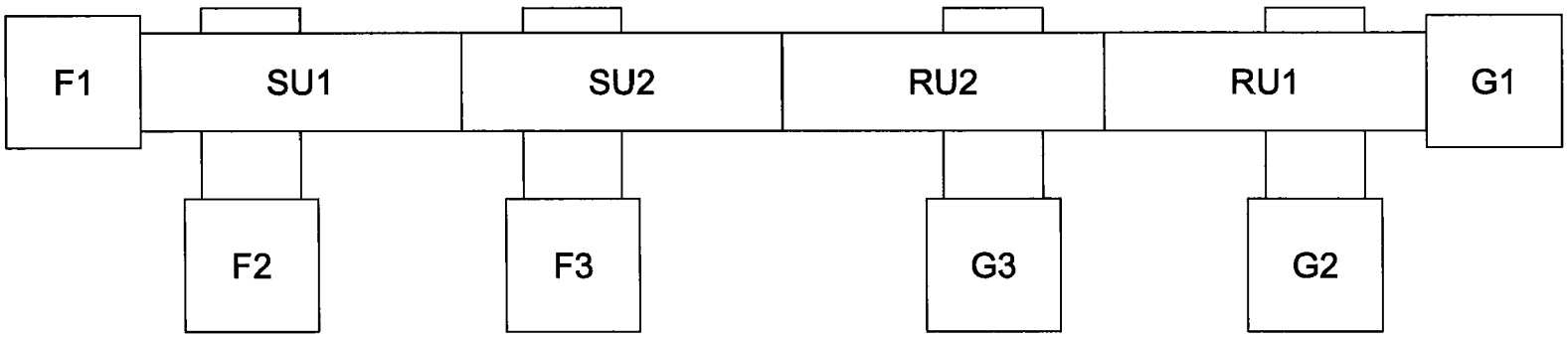
FIG. 7 shows an image forming system, as another embodiment in which three post-finishing apparatuses are combined to three image forming apparatuses, through the sheet conveyance relay unit.

FIG. 7 shows an image forming system, in which three post-finishing apparatuses are combined to three image forming apparatuses, through the sheet conveyance relay unit.

By using the sheet conveyance relay unit of the present invention, the image forming systems can exhibit extensible flexible combinations.

Based on the sheet conveyance relay unit of the present invention, the number of combinations, which are with respect to the plurality of the image forming apparatuses and the plurality of the post-finishing apparatuses, can be increased, and the combinations can be easily changed, whereby the image forming system, being able to process the diversifying jobs, can be realized.

Further, since the plurality of jobs can be processed in parallel, productivity of the image forming system can be improved.

What is claimed is:

1. A sheet conveyance relay unit comprising:

a convergence unit including:

a convergence section comprising a plurality of sheet receiving sections that are respectively connected to a plurality of image forming apparatuses to receive recording sheets, wherein sheet conveyance paths of the plurality of the sheet receiving sections are converged; and a first common sheet-conveyance section which is adapted to convey the recording sheets from the convergence section to a sheet feeding outlet; and a divergence unit including:

a second common sheet-conveyance section which is adapted to convey the recording sheets conveyed from the sheet feeding outlet;

a plurality of sheet feed-out sections which are respectively connected to a plurality of post-finishing apparatuses; and a divergence section which sorts the recording sheets conveyed by the second common sheet-conveyance section onto the plurality of the sheet feed-out sections;

wherein at least one of the sheet receiving sections among the plurality of the sheet receiving sections is adapted to reverse a recording sheet two times, to feed out said recording sheet to the convergence section.

2. The sheet conveyance relay unit of claim 1, wherein at least one of the sheet receiving sections among the plurality of the sheet receiving sections is adapted to change a conveyance direction of a recording sheet 90 degrees, to feed out said recording sheet to the convergence section.

3. The sheet conveyance relay unit of claim 1, wherein the convergence unit and the divergence unit are detachably connected with each other.

4. The sheet conveyance relay unit of claim 1, wherein the sheet conveyance relay unit comprises a plurality of the convergence units.

5. The sheet conveyance relay unit of claim 1, wherein the sheet conveyance relay unit comprises a plurality of the divergence units.

6. A sheet conveyance relay unit comprising:

a convergence unit including:

a convergence section comprising a plurality of sheet receiving sections that are respectively connected to a plurality of image forming apparatuses to receive recording sheets, wherein sheet conveyance paths of the plurality of the sheet receiving sections are converged; and a first common sheet-conveyance section which is adapted to convey the recording sheets from the convergence section to a sheet feeding outlet; and a divergence unit including:

a second common sheet-conveyance section which is adapted to convey the recording sheets conveyed from the sheet feeding outlet;

a plurality of sheet feed-out sections which are respectively connected to a plurality of post-finishing apparatuses; and a divergence section which sorts the recording sheets conveyed by the second common sheet-conveyance section onto the plurality of the sheet feed-out sections;

wherein at least one of the sheet feed-out sections among the plurality of the sheet feed-out sections is adapted to reverse a recording sheet received from the convergence section two times, to feed out said recording sheet to a corresponding post-finishing apparatus.

7. The sheet conveyance relay unit of claim 6, wherein at least one of the sheet feed-out sections among the plurality of the sheet feed-outing sections is adapted to change a conveyance direction of a recording sheet 90 degrees, to feed out said recording sheet to a corresponding post-finishing apparatus.

8. The sheet conveyance relay unit of claim 6, wherein the convergence unit and the divergence unit are detachably connected with each other.

9. The sheet conveyance relay unit of claim 6, wherein the sheet conveyance relay unit comprises a plurality of the convergence units.

10. The sheet conveyance relay unit of claim 6, wherein the sheet conveyance relay unit comprises a plurality of the divergence units.

11. An image forming system comprising:

a plurality of image forming apparatuses, each of which forms images on recording sheets and sends out the recording sheets;

a plurality of post-finishing apparatuses, each of which conducts a post-finishing process on the recording sheets; and a sheet conveyance relay unit comprising:

a convergence unit including:

a convergence section comprising a plurality of sheet receiving sections that are respectively connected to the plurality of image forming apparatuses to receive the recording sheets, wherein sheet conveyance paths of the plurality of the sheet receiving sections are converged; and a first common sheet-conveyance section which is adapted to convey the recording sheets from the convergence section to a sheet feeding outlet; and a divergence unit including:

a second common sheet-conveyance section which is adapted to convey the recording sheets conveyed from the sheet feeding outlet;

a plurality of sheet feed-out sections which are respectively connected to the plurality of post-finishing apparatuses; and a divergence section which sorts the recording sheets conveyed by the second common sheet-conveyance section onto the plurality of the sheet feed-out sections;

wherein at least one of the sheet receiving sections among the plurality of the sheet receiving sections is adapted to reverse a recording sheet two times, to feed out said recording sheet to the convergence section.

12. The image forming system of claim 11, wherein at least one of the sheet receiving sections among the plurality of the sheet receiving sections is adapted to change a conveyance direction of a recording sheet 90 degrees, to feed out said recording sheet to the convergence section.

13. The image forming system of claim 11, wherein the convergence unit and the divergence unit are detachably connected with each other.

14. The image forming system of claim of claim 11, wherein the image forming system comprises a plurality of the convergence units.

15. The image forming system of claim 11, wherein the image forming system comprises a plurality of the divergence units.

16. An image forming system comprising:

a plurality of image forming apparatuses, each of which forms images on recording sheets and sends out the recording sheets;

a plurality of post-finishing apparatuses, each of which conducts a post-finishing process on the recording sheets; and a sheet conveyance relay unit comprising:

a convergence unit including:

a convergence section comprising a plurality of sheet receiving sections that are respectively connected to the plurality of image forming apparatuses to receive the recording sheets, wherein sheet conveyance paths of the plurality of the sheet receiving sections are converged; and a first common sheet-conveyance section which is adapted to convey the recording sheets from the convergence section to a sheet feeding outlet; and a divergence unit including:

a second common sheet-conveyance section which is adapted to convey the recording sheets conveyed from the sheet feeding outlet;

a plurality of sheet feed-out sections which are respectively connected to the plurality of post-finishing apparatuses; and a divergence section which sorts the recording sheets conveyed by the second common sheet-conveyance section onto the plurality of the sheet feed-out sections;

wherein at least one of the sheet feed-out sections among the plurality of the sheet feed-out sections is adapted to reverse a recording sheet two times, to feed out said recording sheet to a corresponding post-finishing apparatus.

17. The image forming system of claim 16, wherein at least one of the sheet feed-out sections among the plurality of the sheet feed-out sections is adapted to change a conveyance direction of a recording sheet 90 degrees, to feed out said recording sheet to a corresponding post-finishing apparatus.

18. The image forming system of claim 16, wherein the convergence unit and the divergence unit are detachably connected with each other.

19. The image forming system of claim of claim 16, wherein the image forming system comprises a plurality of the convergence units.

20. The image forming system of claim 16, wherein the image forming system comprises a plurality of the divergence units.

* * * * *